US007549686B2

(12) United States Patent
Watanabe

(10) Patent No.: US 7,549,686 B2
(45) Date of Patent: Jun. 23, 2009

(54) FINGER FITTING PRODUCT

(76) Inventor: Fumimaru Watanabe, 2-8-20, Shimo-Muneoka, Shiki-shi (JP) 353-0003

( * ) Notice: Subject to any disclaimer, the term of this patent is extended or adjusted under 35 U.S.C. 154(b) by 135 days.

(21) Appl. No.: 11/604,293

(22) Filed: Nov. 27, 2006

(65) Prior Publication Data

US 2008/0036227 A1 Feb. 14, 2008

(30) Foreign Application Priority Data

Aug. 11, 2006 (JP) ..... 2006-220670

(51) Int. Cl.
*B25G 1/10* (2006.01)
*B25J 1/00* (2006.01)
*B43L 15/00* (2006.01)

(52) U.S. Cl. ..... 294/25; 401/8

(58) Field of Classification Search ..... 294/25, 294/171; 16/421, 422, 430; 601/40; 482/49; 401/7, 8

See application file for complete search history.

(56) References Cited

U.S. PATENT DOCUMENTS 1,450,817 A * 4/1923 Porter ..... 401/8
1,554,633 A * 9/1925 Ingram ..... 273/145 A
2,244,072 A * 6/1941 Ledbetter ..... 294/25
2,771,224 A * 11/1956 Boerger ..... 222/210
4,262,898 A * 4/1981 Lee ..... 482/49
4,523,781 A * 6/1985 Brody ..... 294/25
4,711,445 A * 12/1987 Whitehead ..... 482/49
4,754,499 A * 7/1988 Pirie ..... 2/20
5,830,109 A * 11/1998 Juarez ..... 482/44
5,846,010 A * 12/1998 Barbalich ..... 401/186
6,732,374 B1 * 5/2004 Blair ..... 2/20

FOREIGN PATENT DOCUMENTS

| | | |
|---|---|---|
| JP | HEI 2-49579 | 4/1990 |
| JP | HEI 8-336616 | 12/1996 |
| JP | HEI 9-238969 | 9/1997 |
| JP | HEI 10-85282 | 4/1998 |
| JP | HEI 10-277104 | 10/1998 |
| JP | 3077544 | 2/2001 |
| JP | U 3086716 | 4/2002 |
| JP | 2002-143198 | 5/2002 |
| JP | 2002-204806 | 7/2002 |
| JP | 2003-284746 | 10/2003 |
| JP | 2006-6520 | 1/2006 |
| WO | WO 98/35637 | 8/1998 |

* cited by examiner

*Primary Examiner*—Dean J Kramer
(74) *Attorney, Agent, or Firm*—Oliff & Berridge, PLC

(57) ABSTRACT

A finger fitting product includes a grip of a substantially rectangular parallelepiped shape and a finger-through portion including two loops for inserting the middle finger and the third finger of a user thereinto. The finger-through portion is provided at a position close to either one of the longer sides of the surface of the grip so that the grip is just fitted in the palm side when finger fitting product is fitted. On the surface and the back side of the grip, grooves for securing ventilation characteristics when the grip is gripped and preventing the palm from getting sweaty are formed. Furthermore, at a substantially central portion of the grip, a through hole penetrating in the longitudinal direction is formed as appropriate, and in this through hole, a pipe is detachably inserted and fitted.

6 Claims, 3 Drawing Sheets

FINGER FITTING PRODUCT

RELATED APPLICATIONS

This application claims the priority of Japanese Patent Application 2006-220670 filed on Aug. 11, 2006. This application and Japanese Patent Application 2004-186229 (filed on Jun. 24, 2004) are incorporated herein by reference.

FIELD OF THE INVENTION

The present invention relates to a finger fitting product to be fitted on fingers, and more specifically, to improvement in ventilation characteristics and fitting performance and widening of the use thereof.

BACKGROUND OF THE INVENTION

In hospitals, care facilities, and in homes, patients and elderly people, in particular, persons with severe dementia in a state that they cannot freely move their hands and fingers may sometimes continue clenching their hands. If this state is continued, sweat on their palms does not dry, so that they suffer from heat rash or bacteria propagate and emit an odor and a hygienic state cannot be maintained. In order to prevent such sweaty palms, for example, in Patent Document 1 (Japanese Published Unexamined Patent Application No. 2002-204806), a grip pipe is disclosed which is formed so as not to cause a sweaty palm regardless of gripping for a long period of time by utilizing ventilation characteristics at the contact surface and the aeration property of the inner diameter of coarsely wound coils. In addition, in Patent Document 2 (Japanese Utility Model Registration No. 3077544), a palm rehabilitation dry cleaner for nursing care is disclosed for the purpose of maintaining hygiene of a palm and, at the same time, obtaining a rehabilitation effect by gripping a pipe containing dehumidifying, sterilizing, and odor eliminating agents such as absorbent cotton and activated carbon inside the inner diameter portion of the pipe and by penetrating vent holes in the pipe-shaped wall while holding up a thumb.

However, the above-described background arts have the following problems. First, the technique described in Patent Document 1 is devised so as to make the grip pipe harder to come off from a hand by making large both ends of the grip of the coarsely wound coils, however, if the gripping force weakens, the grip pipe may easily come off and be lost. In both the techniques described in Patent Documents 1 and 2, the surface is covered by gauze, cloth or absorbent cotton is filled inside, and these require periodic replacement, and this places a burden on a user or a person who nurses the user. Furthermore, the grip portion is hollow, so that it is insufficient in strength and durability, and it is used exclusively for a nursing case. In particular, since the main object of the background arts is to prevent sweaty palms when users continue clenching their hands, it is not intended to use these as aids for persons with weak grip strength to grip various objects and implements.

SUMMARY OF THE INVENTION

The present invention has been made in view of the above-described circumstances, and an object thereof is to provide a hygienic finger fitting product which does not easily come off from a hand and is excellent in ventilation characteristics. Another object thereof is to provide a finger fitting product which is applicable not only in prevention of palms from getting sweaty but also for other uses.

In order to achieve the objects, a finger fitting product of the present invention includes: a grip body which has a longitudinal length substantially equivalent to a width of a hand and can be gripped by a palm, a finger-through portion which is provided on the surface of the grip body along the longitudinal direction and includes insertion portions into which a plurality of fingers including the middle finger are inserted, and at least one or more grooves or concave portions formed in the surface of the grip body.

One of major aspects of the present invention is characterized by including a through hole penetrating through a substantially central portion of the grip body in the longitudinal direction. Another aspect of the present invention is characterized by including an inserting member to be detachably inserted into the through hole. Still another aspect of the present invention is characterized in that the inserting member includes a hollow pipe that can be inserted through the through hole and a sealing material to be sealed within the pipe, or that is an article or an implement having a handle to be detachably inserted into the through hole.

Still another aspect of the present invention is characterized in that (1) when the grip body is in a shape that is substantially rectangular and has two parallel principal surfaces, the finger-through portion is provided close to either one of the longer sides of the principal surfaces, (2) the size of the grip body is made adjustable, (3) the size of the insertion portions of the finger-through portion is made adjustable, (4) the grip body is elastic, (5) counting means for counting the number of times of gripping the grip body is provided on the grip body, and (6) the grip body has at least any of antimicrobial, deodorization, sterilization, bacteria elimination, antiseptic functions or is aromatic.

The above and other objects, features, and advantages of the present invention will become apparent from the following detailed description taken with the accompanying drawings.

BRIEF DESCRIPTION OF THE DRAWINGS

FIG. 1(A) is a perspective view showing an entire constitution; FIG. 1(B) is a side view, FIG. 1(C) is a drawing showing a usage state, and FIG. 1(D) is a drawing showing another usage state;

FIG. 2(A) shows one usage mode wherein a pipe containing sand is applied to the first embodiment. FIG. 2(B) shows another usage mode wherein a rod-shaped magnet is applied to the first embodiment. FIG. 2(C) shows still another usage mode wherein a toothbrush is applied to the first embodiment. FIG. 2(D) shows even still another usage mode wherein a brush is applied to the first embodiment.

FIG. 3(A) shows one modified mode wherein four grooves are formed in a grip body. FIG. 3(B) shows another modified mode wherein the grip body may be cut along grooves to adjust the size thereof. FIG. 3(C) shows an example of using the grip body for finger training purpose. FIG. 3(D) shows still another modified mode wherein a counter is provided in the grip body.

DETAILED DESCRIPTION OF THE PREFERRED EMBODIMENT

The present invention is susceptible of numerous physical embodiments, depending upon the environment and requirements of use, substantial numbers of the herein shown and described embodiments have been made, tested and used, and all have performed in an eminently satisfactory manner.

Figure 1:
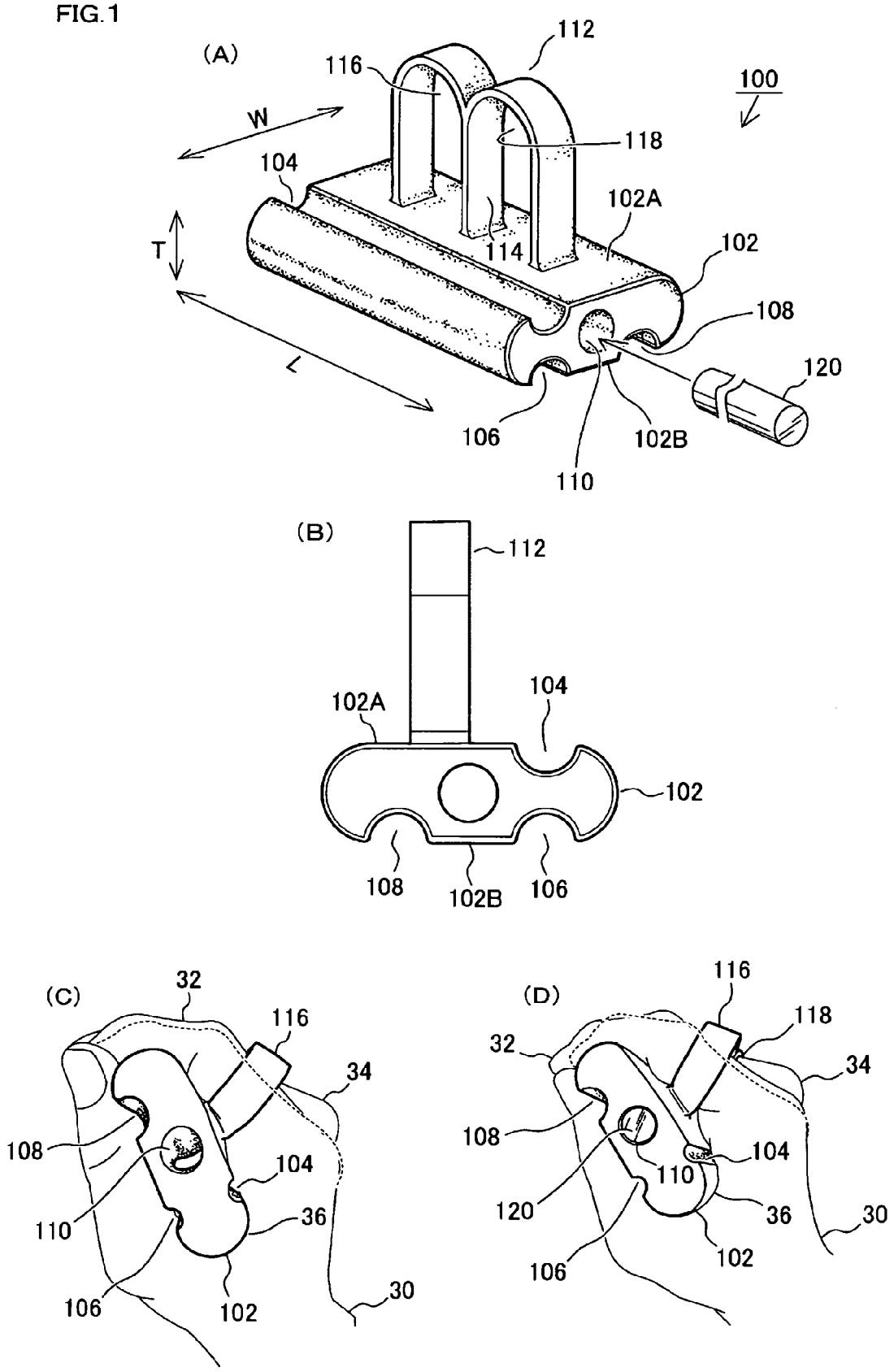
FIG. 1 are drawings showing an embodiment of the present invention.

Next, an embodiment of the present invention will be described in detail with reference to FIG. 1 and FIG. 2. FIG. 1(A) is a perspective view showing an entire constitution of an embodiment of the present invention; FIG. 1(B) is a side view of the embodiment, FIG. 1(C) is a drawing showing a usage state of this embodiment, and FIG. 1(D) is a drawing showing another usage state of this embodiment. FIGS. 2(A) through 2(D) are drawings showing still other usage states of this embodiment. As shown in FIG. 1, a finger fitting product 100 of this embodiment includes a grip 102 in a substantially rectangular parallelepiped shape, and a finger-through portion 112 provided on a surface 102A of the grip 102. The length L in the longitudinal direction of the grip 102 is set in advance so as to become substantially equivalent to a width of a hand of a user 30, and the width W and the thickness T are set in advance such that the user 30 can naturally grip the grip 102.

The finger-through portion 112 is provided along the longitudinal direction of the grip 102, and by a partition 114 provided on substantially the center, two loops 116 and 118 are formed. These loops 116 and 118 are for fitting the middle finger 32 and the third finger 34 of the user 30 through the loops. The finger-through portion 112 is provided at a position close to either one of the longer sides of the surface 102A of the grip 102, and thereby, the grip 102 is just fitted on the palm 36 side when it is used. The finger-through portion 112 is only required to have a structure into which the middle finger 32 and the third finger 34 can be inserted, and may not be provided with the partition 114.

Furthermore, on the surface 102A of the grip 102, a groove 104 is formed in the longitudinal direction. This groove 104 is for maintaining ventilation characteristics when the middle finger 32 and the third finger 34 are inserted through the loops. On the back side 102B of the grip 102, two grooves 106 and 108 are substantially formed parallel along the longitudinal direction, and in the illustrated example, the position of the groove 106 is substantially made coincident with the groove 104 of the surface 102A side. The grooves 106 and 108 are for maintaining ventilation characteristics and preventing the palm 36 from getting sweaty when the hand is clenched while fitting with the finger fitting product 100. When the grip 102 is made of a hard material, the grooves 104, 106, and 108 also bring about an effect of making it flexible as well as the above-described effect of preventing the palm 36 from getting sweaty. Furthermore, in the grip 102, a through hole 110 penetrating through a substantially central portion in the longitudinal direction is formed. The through hole 110 is formed to have a substantially circular shape in the illustrated example, and the pipe 120 shown in FIG. 1(A) is detachably inserted therethrough. The through hole 110 is provided as appropriate.

The above-described grip 102 and finger-through portion 112 are made of various known material such as wood, plastic, or synthetic rubber, however, it is not always necessary that the same material is used for the grip 102 and the finger-through portion 112, and it is possible to use different materials for these, for example, the grip 102 is made of wood and the finger-through portion 112 is made of metal. In this embodiment, silicon rubber having elasticity is used for the grip 102 and the finger-through portion 112, and the pipe 120 is made of various known hard materials. In terms of use as a nursing care item for preventing the palm 36 from getting sweaty, use of a material having antibacterial, sterilization, bacterial elimination effects, etc., for at least the grip 102 is advantageous to maintain a more hygienic state.

Next, actions of this embodiment will be described. A user 30 inserts his/her middle finger 32 and third finger 34 into the loops 116 and 118 of the finger-through portion 112 so that the palm 36 (of the right hand in the illustrated example) turns to the grip 102 side. At this time, when the groove 104 is turned to the palm 36 side, the finger-through portion 112 is provided closer to one longer side (groove 108 side) from the center of the grip 102, so that the entirety of the grip 12 is attached slightly close to the palm 36 side as shown in FIG. 1(C). In this state, the grip 102 can be naturally gripped by a hand, and due to provision of the grooves 104, 106, and 108, the palm 36 and fingers are prevented from being fatigued and getting sweaty in spite of gripping for a continuously long period of time. When the hardness of the grip 102 is insufficient, as shown in FIG. 1(D), by inserting a hard pipe 120 in the through hole 110, the grip 102 can be made hard. When the grip is used for an extended period of time and gets dirty, the entirety thereof is washed, whereby a hygienic state can always be maintained.

Figure 2:
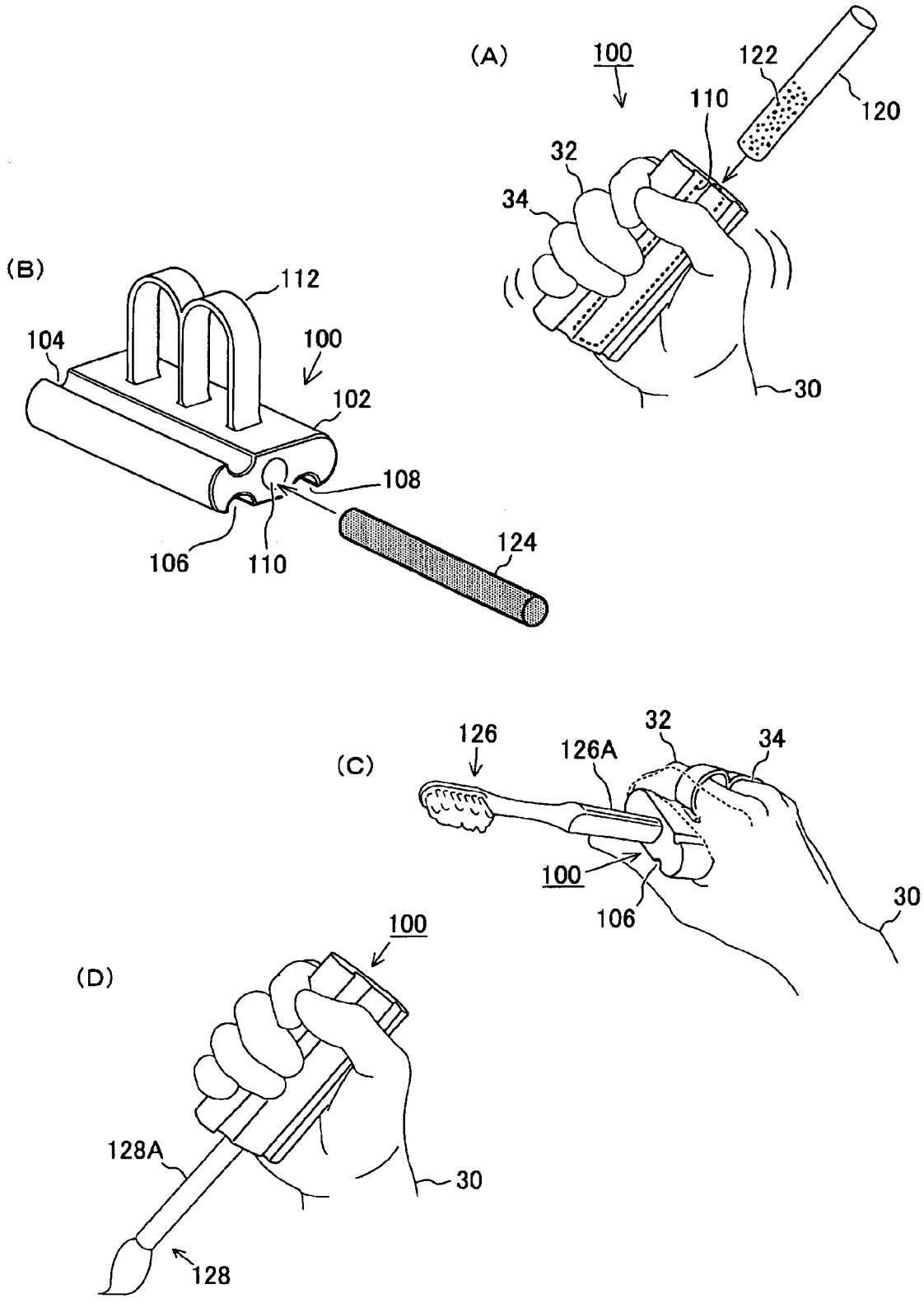
FIGS. 2(A)-2(D) are drawings showing several usage modes based on the first embodiment shown in FIG. 1. Namely.

FIG. 2 show another example of use of the finger fitting product 100. In the example shown in FIG. 2(A), sand 122 is sealed within the pipe 120, and a sound is emitted when the finger fitting product 100 is shaken. It is also possible that the pipe 120 is made of a deformable material so that a sound is emitted when the grip 102 is strongly gripped. The material to be sealed within the pipe 120 may be gravel or germanium particles as well as the sand 122. In the example shown in FIG. 2(B), a rod-shaped magnet 124 is inserted into the through hole 110 so as to obtain an effect that a magnet is considered to exert on the human body.

In the example shown in FIG. 2(C), a handle 126A of a toothbrush 126 is inserted into the through hole 110, and in the example shown in FIG. 2(D), a stem 128A of a brush 128 is inserted into the through hole 110. Generally, the handle 126A of the toothbrush 126 and the stem 128A of the brush 128 have a thickness of approximately 1 cm, so that they are easily dropped if a force to grip these is weak. However, by gripping the grip 102 while fitting the handle 126A or stem 128A in the through hole 110 of the finger fitting product 100, the toothbrush 126 and the brush 128 can be indirectly held. When the grip 102 is made of an elastic material, etc., the orientation of the handle 126A or stem 128A can be adjusted by being rotated.

As described above, this embodiment has the following effects:

(1) On the surface 102A of the grip 102 having a length substantially equivalent to a width of a hand, a finger-through portion 112 provided with loops 116 and 118 into which the middle finger 32 and the third finger 34 are inserted is provided, and on the surface 102A and the back side 102B of the grip 102, ventilation grooves 104, 106, and 108 are provided, so that without easily coming off from a hand, the hand is prevented from getting sweaty and generation of odors is suppressed, and a hygienic state can be maintained. Even when a slightly hard material is used for the grip 102, the grip 102 can be made flexible by forming the grooves 104, 106, and 108.

(2) At a substantially central portion of the grip 102, a through hole 110 penetrating in the longitudinal direction is formed, and a pipe 120 is detachably inserted into the through hole 110, so that the hardness of the grip 102 can be adjusted by attaching and detaching the pipe 120.

(3) A handle 126A of a toothbrush 126 or a stem 128A of a brush 128 is inserted into the through hole 110 of the grip 102, so that the toothbrush 126 or the brush 128 can be indirectly held and used even when the force to grip the grip is weak.

(4) The finger-through portion 112 is provided close to either one of the longer sides of the surface 102A of the grip 102, so that when the finger fitting product is fitted, the grip 102 can be naturally fitted in the palm and comfortably used even for a long period of time.

(5) It is not necessary to set a gauze or cloth, so that the burden on a user 30 or a person who nurses the user 30 can be reduced.

The present invention includes a large number of other embodiments, and can be variously altered based on the above-described disclosure. For example, the following embodiments are also included:

(1) The shapes and sizes shown in the embodiment described above are examples, and these may be changed as appropriate so as to bring about the same effects. Materials therefor can be appropriately changed as necessary. In the embodiment described above, use of a material having antibacterial, sterilization, and bacteria elimination functions, etc., for the grip 102 is shown, however, other than this, the grip 102 can be changed as appropriate to, for example, a material which has deodorization and antiseptic functions or emits aroma.

(2) The finger-through portion 112 shown in the embodiment described above is also an example, and the design thereof can be changed as appropriate so as to bring about the same effects.

Figure 3:
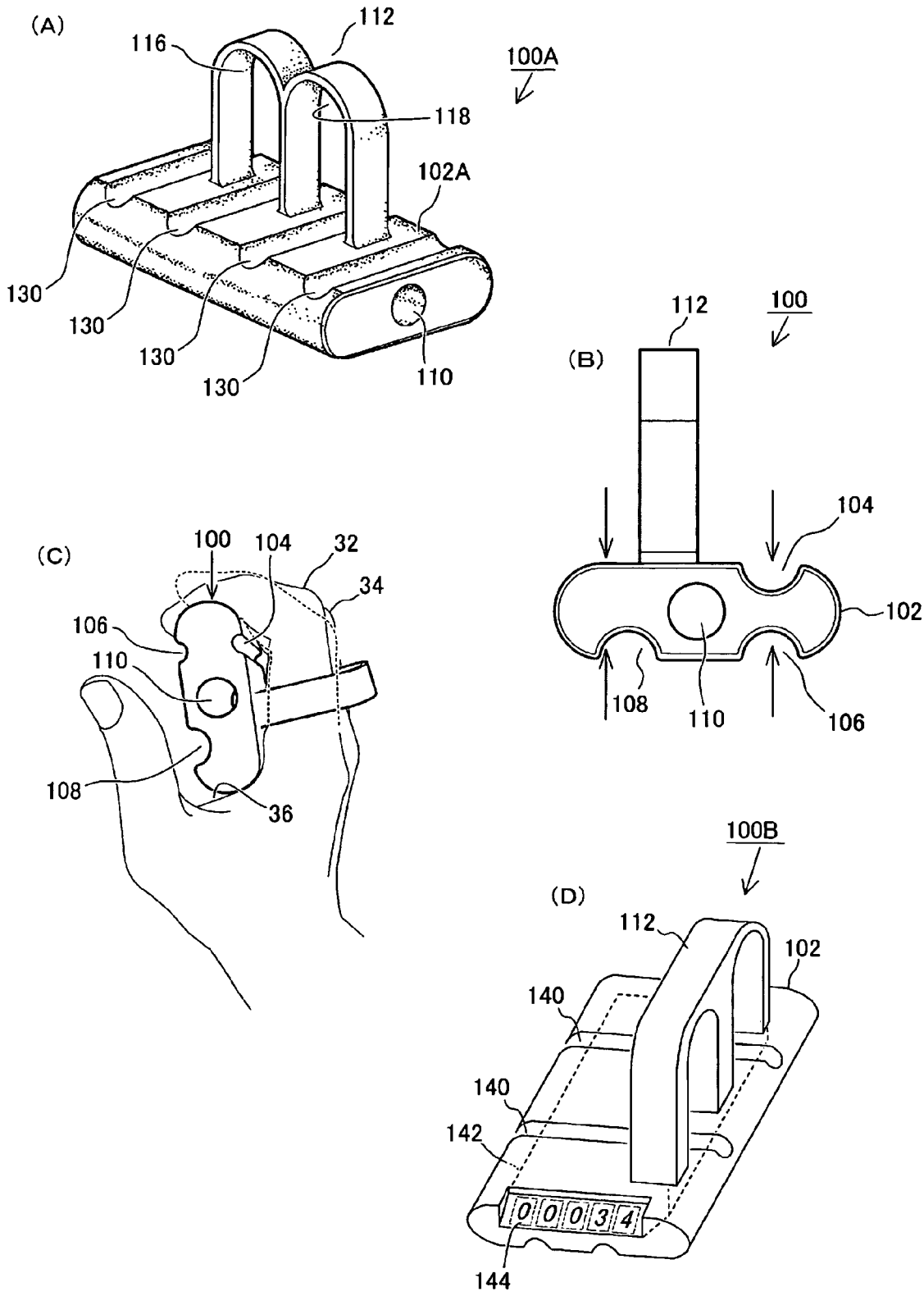
FIGS. 3(A)-3(D) are drawings showing several other modified modes of the invention Namely.

(3) In the embodiment described above, grooves are provided in the longitudinal direction of the grip 102, however, this is also an example, and like the finger fitting product 100A shown in FIG. 3(A), by forming four grooves 130 substantially parallel in a direction substantially orthogonal to the longitudinal direction at positions corresponding to fingers on the surface 102A of the grip 102, ventilation characteristics at the portions that come into contact with fingers can be further improved.

(4) The grooves 104, 106, and 108 shown in the embodiment described above are also examples, and the positions and the number of grooves may be changed as appropriate. As shown in FIG. 3(B), the grip 102 can be cut along the grooves 104, 106, and 108 to adjust the size thereof.

(5) The toothbrush 126 and the brush 128 shown in the embodiment described above are also examples, and as an object to be inserted into the through hole 110, various other known articles and implements such as a spoon and fork may be applied.

(6) In the embodiment described above, as shown in FIG. 1(C), the finger fitting product 100 is fitted so that the groove 104 turns to the palm 36, that is, the finger fitting product 100 comes slightly close to the palm 36, whereby the finger fitting product 100 is gripped by the whole hand and used as an aid for training and preventing the hand from getting sweaty or gripping various implements and articles, however, this is also an example and is not intended to deter other fitting methods. For example, as shown in FIG. 3(C), when the finger fitting product 100 is fitted so that the grooves 104 and 106 turn toward the tips of the fingers, the whole finger fitting product 100 is fitted slightly close to the finger side, so that it can be mainly used for training the fingers. Of course, the same applies to a finger fitting product for a left hand that is not shown.

(7) Furthermore, like the finger fitting product 100B shown in FIG. 3(D), it is also possible that a grip 102 formed with a finger-through portion 112 and a groove 140 is made of an elastic material, a counter 142 for counting the number of times of gripping is installed inside the grip 102, and the number of times is confirmed at a display 144.

(8) In the embodiment described above, the finger fitting product of the present invention is used as a nursing care item for preventing the palm 36 from getting sweaty and an aid for holding a musical instrument, a toothbrush 126, or a brush 128, however, these are also examples, and the present invention is also applicable to various uses such as aids for holding a musical instrument, training implements, and other articles and implements as well as a nursing care item.

As described above, according to the present invention, a finger fitting product is formed by providing a finger-through portion for inserting a plurality of fingers including the middle finger along the longitudinal direction and at least one or more grooves or concave portions on a surface of a grip body having a length substantially equivalent to a width of the hand. Therefore, a hygienic state can be maintained while maintaining high ventilation characteristics and fitting performance without easily coming off from a hand. In addition, by making the grip body fit both the palm and the back of the hand, the grip body brings about not only an effect of preventing the palm from getting sweaty but also various other effects such as an effect of training or protecting the palm. Furthermore, by forming a through hole penetrating through a substantially central portion of the grip body in the longitudinal direction and inserting a pipe or an inserting member such as a handle of various articles and implements into the through hole, use for a musical instrument and use as an aid for holding various articles and implements become possible.

As many apparently widely different embodiments of this invention may be made without departing from the spirit and scope thereof, it is to be understood that the present invention is not limited to the specific embodiments thereof except as defined in the appended claims.

The invention claimed is:

1. A finger fitting product to be gripped by a hand of a user, while allowing at least two fingers of said user to be fitted thereto, said finger fitting product comprising:

a grip body of an elastic property, said grip body extending in the longitudinal direction thereof, having a length substantially equal to a width of said hand of said user, and being of such a substantially rectangular cross-sectional configuration that can be gripped and held by: a first finger of said user; other four fingers of the user than said first finger; and a palm of the user, wherein said first finger is a thumb of the user;

said grip body having:

a first substantially flat surface over which said other four fingers and one local region of said palm adjacent to said other four fingers are to extend;

a second substantially flat surface over which said first finger and another local region of said palm adjacent to said first finger are to extend, said second substantially flat surface being defined opposite to said first substantially flat surface;

a first longitudinally extending lateral surface defined between said first and second substantially flat surfaces so as to extend in the longitudinal direction of said grip body;

a second longitudinally extending lateral surface defined between said first and second substantially flat surfaces so as to extend in the longitudinal direction of said grip body on a side opposite to said first longitudinally extending lateral surface, a first transversely extending lateral surface extending in a direction transversely of said grip body and being defined between said first and second substantially flat surfaces and as well as between said first and second longitudinally extending lateral surfaces; and a second transversely extending lateral surface extending in a direction transversely of said grip body and being defined opposite to said first transversely extending lateral surface and also defined between said first and second substantially flat surfaces and as well as between said first and second longitudinally extending lateral surfaces;

a finger-insertion portion for allowing at least two of said other four fingers of said user, inclusive of a middle finger of the user, to be releasably inserted and fitted therein, said finger-insertion portion being fixed on said first substantially flat surface so as to extend in the longitudinal direction of said grip body;

at least one ventilation recessed portion formed in said first substantially flat surface so as to extend in the longitudinal direction of said grip body and open in both of said first and second transversely extending lateral surfaces, said at least one ventilation recessed portion being adapted for allowing ventilation with regard to said one local region of said palm which is to overlie and extend across said particular at least one ventilation recessed portion;

a through hole formed in said grip body so as to extend therethrough along substantially a longitudinal central axis of the grip body and open in both of said first and second transversely extending lateral surfaces, thus defining a first opening in said first transversely extending lateral surface and a second opening in said second transversely extending lateral surface; and an inserting member having a first portion and a second portion, wherein said first portion is adapted to be detachably inserted in said through hole from a selected one of said first and second openings, with said second portion projecting from said selected one of said first and second openings and thus extending outwardly from one of said first and second transversely extending lateral surfaces;

wherein said at least one ventilation recessed portion and said finger-insertion portion are arranged substantially symmetrically relative to said longitudinal central axis of said grip body, in such a manner that said at least one ventilation recessed portion is disposed near to said first longitudinally extending lateral surface, whereas said finger-insertion portion is disposed near to said second longitudinally extending lateral surface.

2. The finger fitting product according to claim 1, which further comprises: at least two other ventilation recessed portions formed in said second substantially flat surface so as to extend in the longitudinal direction of said grip body and open in both of said first and second transversely extending lateral surfaces, with such an arrangement that one of said at least two other ventilation recessed portions is disposed near to said first longitudinal lateral surface, while another of said at least two other ventilation recessed portions is disposed near to said second longitudinal lateral surface, wherein said one of said at least two other ventilation recessed portions is adapted for allowing ventilation with regard to said another local region of said palm which is to overlie and extend across said particular one of said at least two other ventilation recessed portions, and wherein said another of said at least two other ventilation recessed portions is adapted for allowing ventilation with regard to said first finger and tip portions respectively of said other four fingers, both of which are to overlie and extend across said another of said at least two other ventilation recessed portions.

3. The finger fitting product according to claim 2, wherein said recessed portions each comprises a groove or a concave portion.

4. The finger fitting product according to claim 1, wherein said inserting member is an article or implement having: a handle portion corresponding to said first portion of the inserting member; and a main body portion extending from said handle portion, said main body portion corresponding to said second portion of the inserting member.

5. The finger fitting product according to claim 1, wherein said grip body is provided with counting means for counting the number of times of gripping the grip body.

6. The finger fitting product according to claim 1, wherein said grip body has at least one selected from the group consisting of: antibacterial function; deodorization function; sterilization function; bacterial elimination function; antiseptic function; and aromatic property.

* * * * *